US005930860A

United States Patent [19]

Shipp

[11] Patent Number: 5,930,860

[45] Date of Patent: Aug. 3, 1999

[54] PROPHY BRISTLE TOOTHBRUSH

[76] Inventor: Anthony D. Shipp, 351 N. Foothill Rd., Beverly Hills, Calif. 90210

[21] Appl. No.: 08/622,732

[22] Filed: Mar. 27, 1996

[51] Int. Cl.[6] ..... A46B 9/04

[52] U.S. Cl. ..... 15/110; 15/167.1; 15/207.2; 15/DIG. 5; 15/188; 601/139

[58] Field of Search ..... 15/110, 107, 106, 15/167.1, DIG. 5, 207.2, 167.2, 160, 188, 186, 187; 601/139, 141

[56] References Cited

U.S. PATENT DOCUMENTS

| | | | |
|---|---|---|---|
| D. 49,472 | 8/1916 | Dierke | 15/167.1 |
| D. 139,264 | 10/1944 | Littig | 15/167.1 |
| 301,644 | 7/1884 | Thompson | 15/186 |
| 1,188,823 | 6/1916 | Plank | 15/167.1 |
| 1,268,544 | 6/1918 | Cates | 15/167.1 |
| 1,598,224 | 8/1926 | Van Sant | 15/167.1 |
| 1,965,009 | 7/1934 | Stevens | 15/167.1 |
| 2,059,914 | 11/1936 | Rosenberg | 15/167.1 |
| 2,225,331 | 12/1940 | Campbell | 15/188 |
| 2,279,355 | 4/1942 | Wilensky | 15/110 |
| 2,312,828 | 3/1943 | Adamsson | 15/167.1 |
| 2,545,804 | 3/1951 | Kempster | 15/167.1 |
| 2,637,870 | 5/1953 | Cohen | 15/186 |
| 2,702,914 | 3/1955 | Kittle et al. | 15/110 |
| 3,007,441 | 11/1961 | Eyer | 15/167.1 |
| 3,103,027 | 9/1963 | Birch | 15/110 |
| 3,188,673 | 6/1965 | Newman | 15/167.1 |
| 3,553,759 | 1/1971 | Kramer et al. | 15/110 |
| 3,624,667 | 11/1971 | Muhler | 15/167.1 |
| 3,742,549 | 7/1973 | Scopp et al. | 15/167.1 |
| 3,754,295 | 8/1973 | Hyman | 15/167.1 |
| 4,053,959 | 10/1977 | Wiley | 15/167.1 |
| 4,150,457 | 4/1979 | Larson | 15/167.1 |
| 4,185,349 | 1/1980 | Papas | 15/167.1 |
| 4,288,883 | 9/1981 | Dolinsky | 15/167.1 |
| 4,493,125 | 1/1985 | Collis | 15/110 |
| 4,519,111 | 5/1985 | Cavazza | 15/167.1 |
| 4,524,478 | 6/1985 | Ross | 15/167.1 |
| 4,738,001 | 4/1988 | Shipp | 15/106 |
| 4,766,633 | 8/1988 | Clark | 15/167.1 |
| 5,010,906 | 4/1991 | Preciutti | 15/167.1 |
| 5,040,260 | 8/1991 | Michaels | 15/167.1 |
| 5,570,487 | 11/1996 | Schneider | 15/167.1 |
| 5,604,951 | 2/1997 | Shipp | 15/110 |

FOREIGN PATENT DOCUMENTS

| | | | |
|---|---|---|---|
| 619577 | 4/1927 | France | 15/167.1 |
| 642228 | 10/1927 | France . | |
| 1745099 | 6/1992 | U.S.S.R. | 15/167.1 |

OTHER PUBLICATIONS

Harvey, Dr. Colin E., "Most common small animal disease countered with preventive dentistry". *DVM*, Apr., 1986.

DVM, "Your Animal Friend". *DVM*, Summary 1986.

Gherna, Carla and Rydalch, Ina, "There's more to life than people". *Cerritos College Dental Hygiene.*

Wilson, Jo Engle; Kravitz, Sandy McCandliss; Powers, Barbara, "Is Dental Hygiene Just for People?", *SCDHA Journal,* Summer 1984.

Pet Nutrition and Care Research Staff, "Dental Care: an important safeguard for a dog's health", *Purina Kennel News,* vol. 85, Issue 3.

Hartman, Deb, "Periodontitis In Canines", *American VVeterinary Dental Society, AVDS News Letter,* Spring 1985, vol. 2, No. 1.

Ryan, C.P., "Dental Problems In Animals", *Today's Animal Health,* pp. 12–15.

"Canine Dentistry—Symposium Proceedings", *Annual Eastern States Veterinary Conference*, Jan. 1984.

Frost, Patricia, "Canine Dentistry; Dental Calculus".

*Primary Examiner*—Gary K. Graham

*Attorney, Agent, or Firm*—Lyon & Lyon LLP

[57] ABSTRACT

A toothbrush for cleaning and polishing teeth includes a handle attached to a brush head. Attached to the brush head are a plurality of elastomeric prophy bristles for polishing teeth, and a plurality of bristle tufts for scrubbing teeth, the bristle tufts being attached to the brush head and placed about the perimeter of the prophy bristles.

4 Claims, 4 Drawing Sheets

PROPHY BRISTLE TOOTHBRUSH

BACKGROUND OF THE INVENTION

1. Field of the Invention

This invention relates generally to toothbrushes used for the cleaning of teeth and gums.

2. Background Information

Cleaning of teeth is very important because unclean teeth are primarily responsible for the most common disease encountered in human and animal medicine—gingivitis and periodontal disease (or periodontitis). Periodontal disease is a term used to describe diseases of the tooth attachment apparatus, the gums, tooth roots, bone surrounding the teeth, and the periodontal ligament tissue joining tooth to bone. Symptoms range from gum inflammation (gingivitis), formation of plaque (food and bacteria), and bad breath (halitosis), to serious accumulation of tartar (mineralized plaque), bleeding, receded or eroded gums, loose or infected teeth, and eventual loss of teeth. Periodontal disease is also the major cause of bad breath in human beings, dogs, and cats. If untreated, periodontal disease often leads to severe damage of major organ systems, and can shorten the life of the afflicted human being or animal. Thus, teeth cleaning is essential to good health.

When teeth are cleaned by a dentist or dental hygienist, generally instruments such as scalers and curettes are used initially to clean the crown and subgingival (under the gums) portions of the tooth. After this cleaning has been performed, a prophylaxis polishing cup, or "prophy cup", mounted on a low-speed dental handpiece is employed. The prophy cup is typically made of a soft rubber-like material and contains at least one central cavity portion that is loaded with pumice paste or another similar abrasive. The prophy cup is then held against the surface of a tooth while being mechanically rotated, e.g., by means of the dental handpiece. This procedure forces the pumice paste to abrade across the surface of the tooth, thereby polishing the tooth, leaving as smooth a surface as possible. A smooth tooth surface helps reduce future plaque and calculus (tartar) build up. Plaque builds up within hours of tooth brushing and the smoother the surface of the tooth, the longer it takes for plaque to adhere to the tooth.

Normal dental hygiene is then continued outside of the dental office and includes regular brushing of the teeth with a toothbrush. This brushing typically occurs one to three times a day. Before brushing, toothpaste is placed on top of the bristles on the toothbrush. During brushing, the bristles of the toothbrush act to scrub the teeth. The use of toothbrushes for dental hygiene has been described in U.S. Pat. No. 4,738,001, which is incorporated herein by reference.

Toothbrushes also commonly utilize relatively flat handles. After brushing the teeth on one side of a mouth, the toothbrush user then typically uses the thumb and forefinger to rotate the toothbrush in the hand in preparation for brushing the teeth on the other side of the mouth. The relatively flat sides of toothbrush handles can make it uncomfortable to hold a toothbrush. Flat toothbrush handles also can make it uncomfortable to rotate the toothbrush in the hand as one prepares to switch from brushing one side of the mouth to the other side. Users often, instead of rotating the toothbrush in their hands, pronate or supinate the wrist of the hand, and elbow of the arm, holding the toothbrush as they switch from brushing one side of the mouth to the other side. This alternating pronation and supination can be uncomfortable.

The above described conventional dental hygiene program also suffers from a number of other major disadvantages. During the brushing process, the toothbrush bristles generally do not follow the contours of teeth as closely as the soft, rubber-like prophy cup. Therefore, the teeth are not left with a surface that is as smooth as desired and the detrimental early onset of periodontal disease is encouraged.

Further, during the tooth brushing process, upon contact of the toothpaste covered bristles with teeth, the toothpaste is spread into the mouth and between the toothbrush bristles, and does not concentrate its effect directly on the teeth in contact with the bristles. Therefore, the toothpaste does not act as effectively as it could.

Also, often times conventional toothbrushes are designed with relatively thick bristles which can cause problems with sensitive gums and teeth. Since gingivitis and periodontal disease often starts in the area below the gum line, the cleaning of this area is extremely important.

Therefore, a need was perceived for a toothbrush that would clean teeth and gums, and in the process leave the teeth with a smoother surface than conventional toothbrushes, make more effective use of toothpaste, and improve the cleaning of the area below the gum line, as well as be comfortable to hold and manipulate.

SUMMARY OF THE INVENTION

In a first inventive aspect, the present invention is directed to a toothbrush that satisfies the foregoing need for improved dental cleaning. In a second inventive aspect, the present invention is directed to a toothbrush that satisfies the foregoing need for a toothbrush that is comfortable to hold and manipulate.

A toothbrush having features of the present invention comprises a platform upon which may be mounted elastomeric bristles. In the preferred embodiment, the platform comprises a handle, and a brush head, the brush head being attached to the handle. The elastomeric bristles may be generally conical in shape. The soft rubber-like, or elastomeric bristles follow the contours of teeth more effectively than ordinary nylon bristles, and provide for polishing of the teeth. Also secured to the brush head is a plurality of bristle tufts. The arrangement of bristle tufts and the elastomeric bristles provides for both bristles that scrub the surface of and in between teeth, as well as a soft rubber-like element that polishes and smoothes the surface of the teeth.

In another inventive aspect of the preferred embodiment, a rounded or cylindrical handle with a beveled region provides a comfortable grip while facilitating the manipulation of the handle.

Accordingly, it is an object of the present invention to provide an improved toothbrush for scrubbing and polishing of teeth and the cleaning of gums. Other and further objects and advantages will appear hereinafter.

BRIEF DESCRIPTION OF THE DRAWINGS

It is to be understood that the accompanying drawings are provided for the purpose of illustration only, and are not intended as a definition of the limits of the invention. The drawings schematically illustrate a preferred embodiment of the present invention in which.

DETAILED DESCRIPTION OF THE PREFERRED EMBODIMENT

Figure 1:
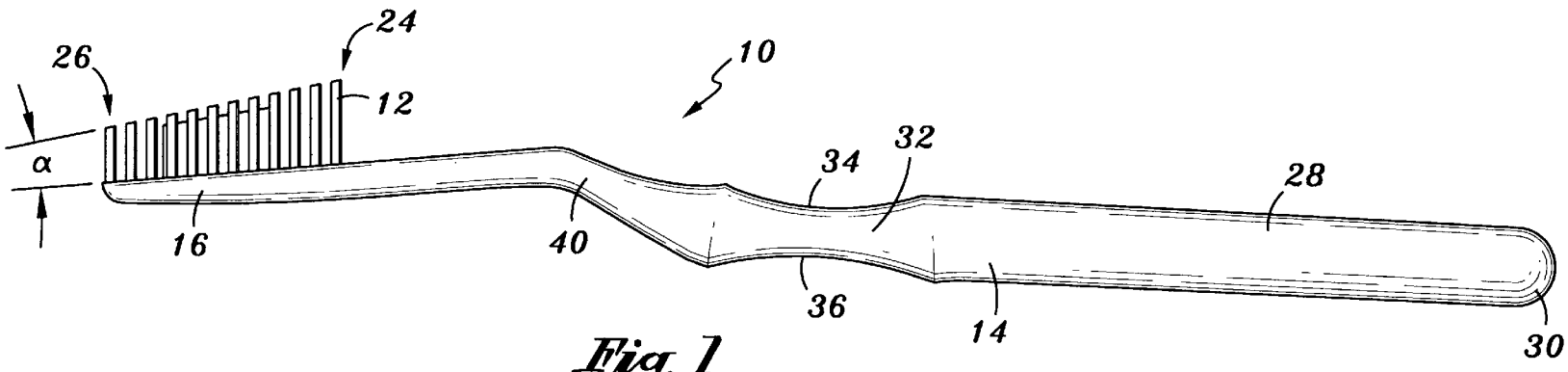
FIG. 1 is a side elevation view of a prophy bristle toothbrush in accordance with the preferred embodiment.

Referring to the drawings, FIG. 1 shows a toothbrush 10. The toothbrush 10 comprises a platform upon which bristle tufts 12 are mounted. In the preferred embodiment the platform comprises a handle 14, and a brush head 16 connected to the handle 14.

Figure 2:
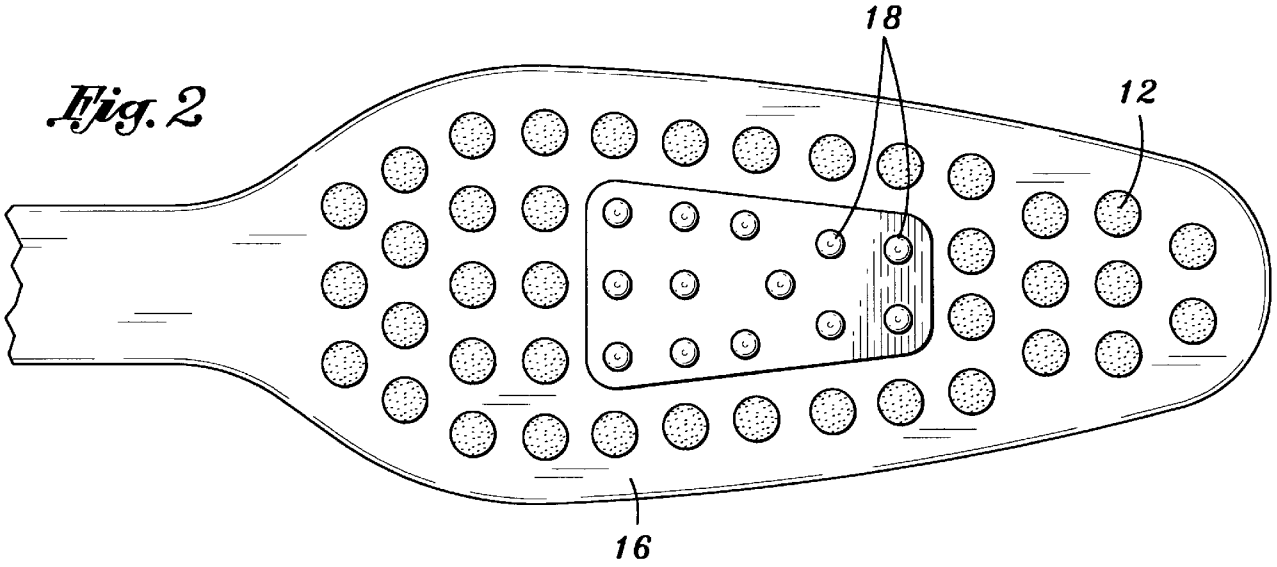
FIG. 2 is an enlarged plan view of the head portion of the prophy bristle toothbrush of FIG. 1.

As shown in FIG. 2, in the preferred embodiment, the brush head 16 is of a generally trapezoidal shape. It would be apparent to one skilled in the art however, that the brush head 16 could be formed in other shapes, such as rectangles, ovals, and circles.

Figure 3:
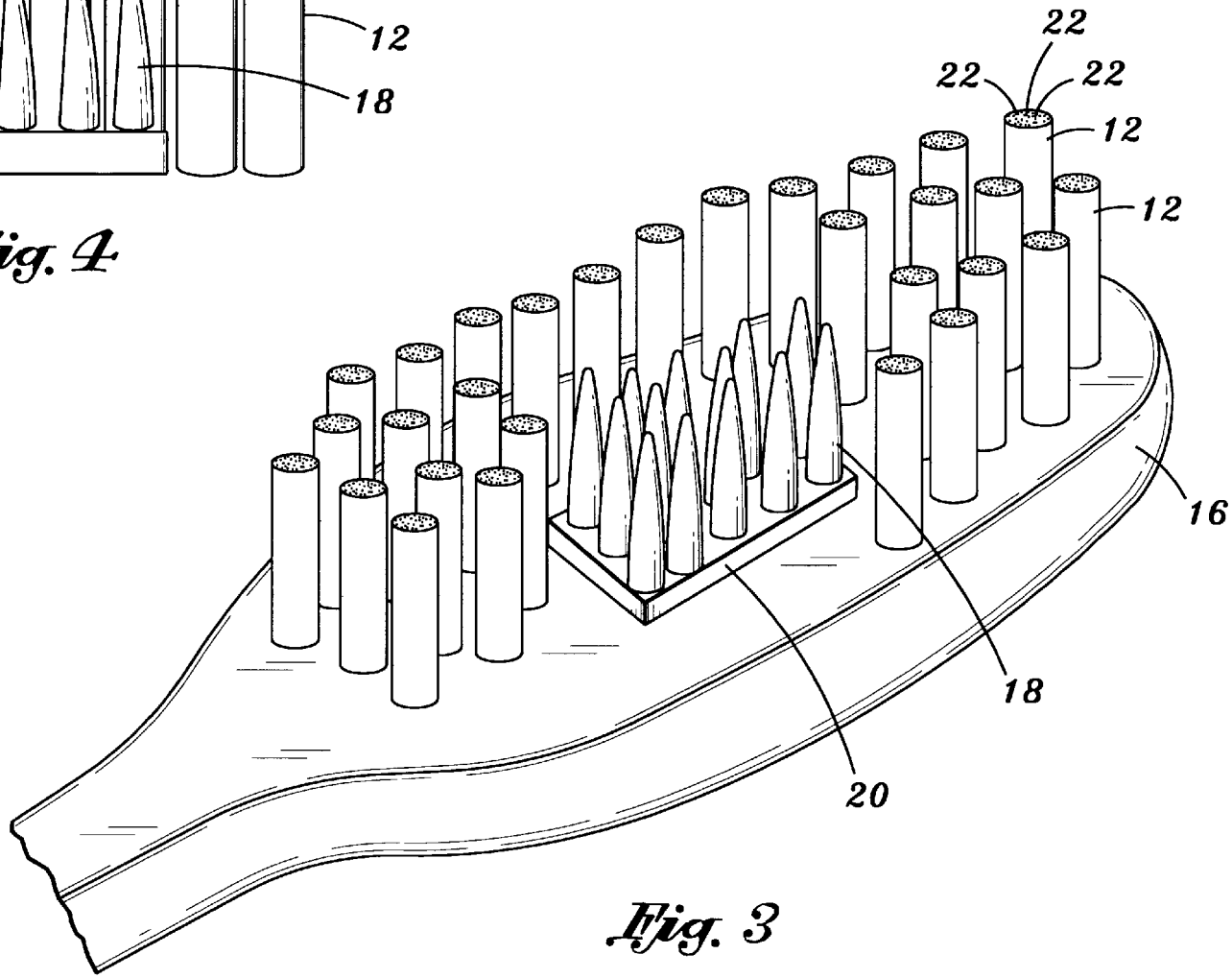
FIG. 3 an enlarged perspective, and partial cutaway, view of the head portion of the prophy bristle toothbrush of FIG. 1 illustrating the spatial relation of prophy bristles to bristle tufts.
Figure 4:
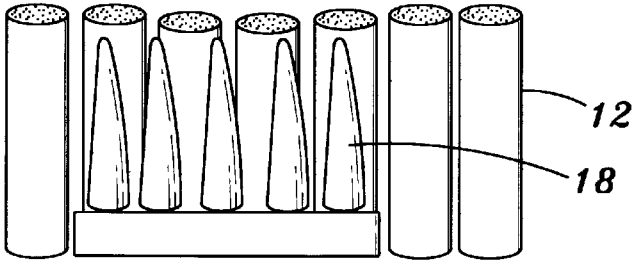
FIG. 4 is an enlarged cutaway elevation view illustrating the relative heights of the prophy bristles and bristle tufts for the prophy bristle toothbrush of FIG. 1.

Secured to the brush head 16, in addition to bristle tufts 12, is a plurality of prophy bristles 18. The prophy bristles 18, as best shown in FIGS. 3 and 4 are of a generally, or substantially, conical shape. In the preferred embodiment, the prophy bristles 18 are made of a soft, flexible rubber, elastomeric, or rubber-like material. The prophy bristles 18 may also be mounted on a base 20. The base 20 may be of the same material as the prophy bristles 18, and the base 20 and prophy bristles 18 may be molded as a single piece that is secured to the brush head 16.

In a preferred embodiment, the prophy bristle toothbrush 10 has a number of prophy bristles 18. Of course, other embodiments may have fewer bristles, or as in an alternate preferred embodiment shown in FIG. 5, may have significantly more prophy bristles 118. These prophy bristles 118 may be smaller and more densely packed than larger prophy bristles 18 of other embodiments.

Figure 6:
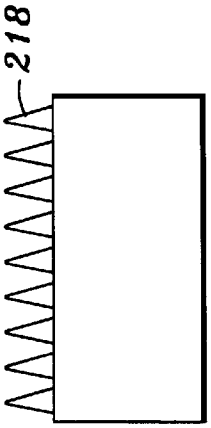
FIG. 6 is a cutaway elevation view illustrating sharply conical prophy bristles for use with the prophy bristle toothbrush of FIG. 1.
Figure 7:
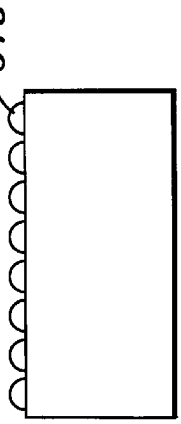
FIG. 7 is a cutaway elevation view illustrating hemispherical prophy bristles for use with the prophy bristle toothbrush of FIG. 1.
Figure 8:
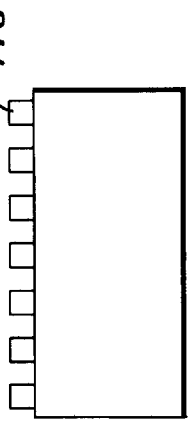
FIG. 8 is a cutaway elevation view illustrating rectangular prophy bristles for use with the prophy bristle toothbrush of FIG. 1.
Figure 5:
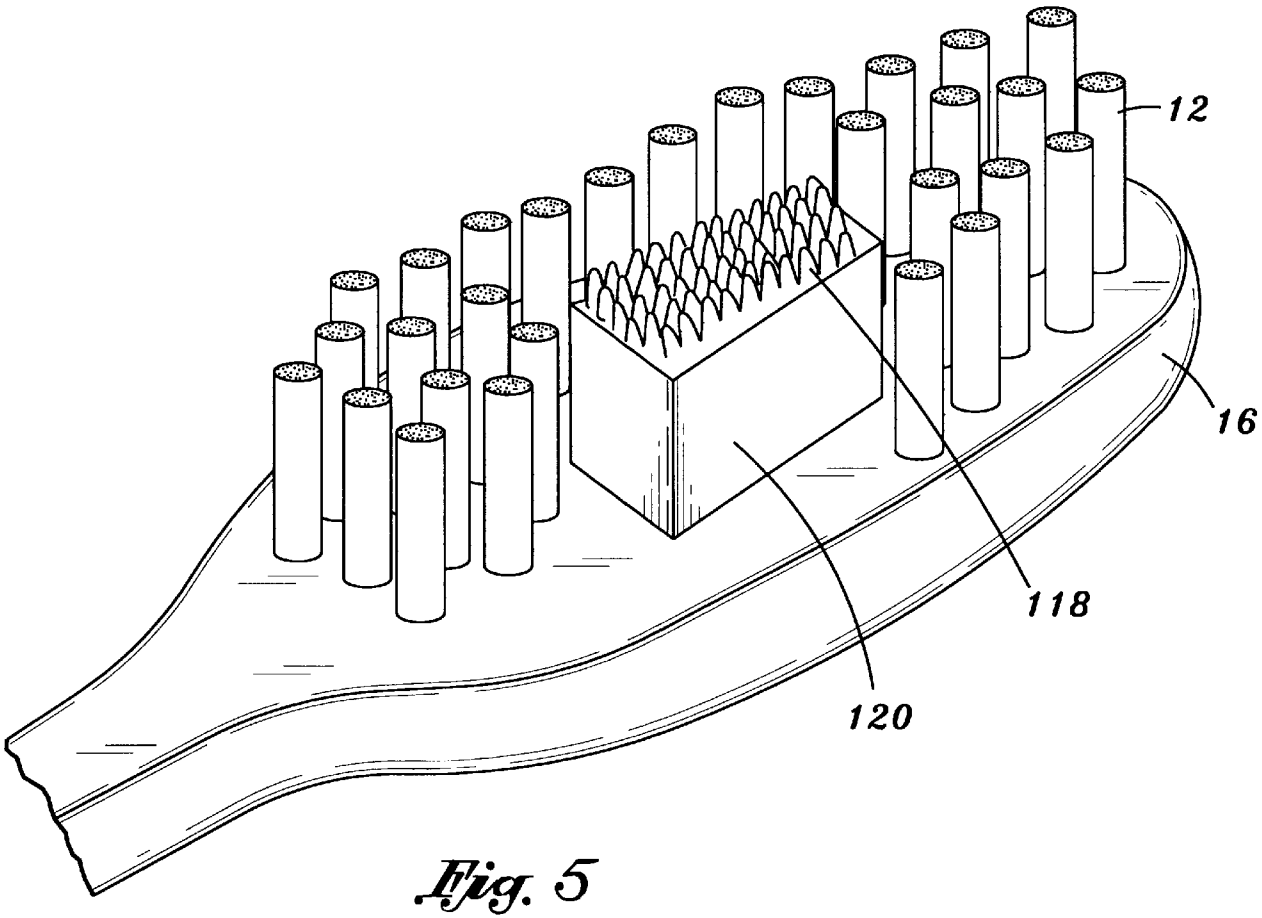
FIG. 5 an enlarged perspective, and partial cutaway, view of the head portion of the prophy bristle toothbrush of FIG. 1 illustrating an alternate design of prophy bristles and the spatial relation of prophy bristles to bristle tufts.

In the alternate embodiment shown in FIG. 5, the smaller prophy bristles 118 are mounted on a base 120 which is larger than the base 20 of other embodiments. The prophy bristles 118 of the embodiment shown in FIG. 5 are generally of a rounded conical shape. Of course, as shown in FIGS. 6–8, prophy bristles of many other shapes may be effectively employed, including at least, sharply conical prophy bristles 218 (FIG. 6), rounded or hemispherical prophy bristles 318 (FIG. 7), and rectangular prophy bristles 418 (FIG. 8). While thicker than the bristles of the bristle tufts 12, the prophy bristles shown and described tend to apply toothpaste firmly to teeth and tend to polish teeth more effectively than bristle tufts 12.

As best shown in FIGS. 3 and 5, secured to the brush head 16 are a plurality of bristle tufts 12. The bristle tufts 12 are generally placed around the perimeter of the of the prophy bristles 18, 118. Each bristle tuft 12 is composed of a plurality of individual bristles 22. In the preferred embodiment these individual bristles 22 are made of synthetic material, preferably nylon, and are approximately 0.005 to 0.006 inches in diameter. This bristle diameter allows the bristles 22 to bend easily and causes the bristles to be gentle on the gums.

As shown in FIG. 4, the bristle tufts 12 may extend above the prophy bristles 18. In the preferred embodiment, the amount of extension is approximately 1.5 to 2 millimeters. Thus, the bristle tufts 12 contact and scrub teeth during brushing before the prophy bristles 18 contact the teeth. Alternate embodiments may have prophy bristles 18 the same height or higher than the bristle tufts 12.

The toothbrush 10 described herein may be of substantial benefit both to human beings, and to animals. Therefore, to provide easy access to the mouth, and efficient cleaning of teeth, in the best mode, the bristle tufts 12, as best shown in FIG. 1, preferably taper at an angle $\alpha$, between 5 to 8 degrees, from a portion 24 most proximal to the handle 14 to a portion 26 most distal from the handle 14, with respect to the brush head 16. The prophy bristles 18 taper similarly.

Figures 9, 10, 11:
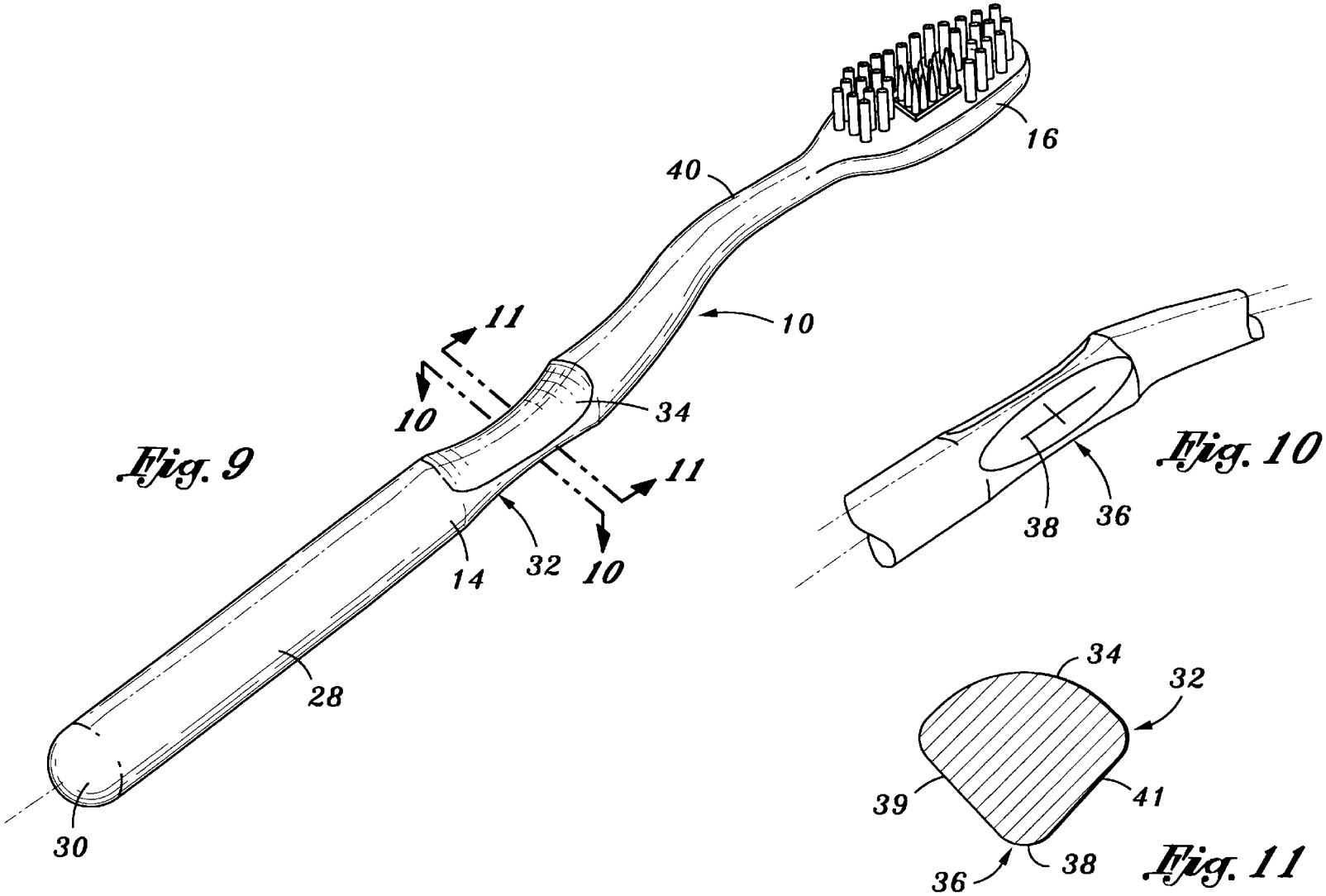
FIG. 9 is a perspective view, illustrating details of the handle of the prophy toothbrush of FIG. 1.
FIG. 10 is a partial cutaway view taken along line 10—10 in FIG. 9.
FIG. 11 is an enlarged cross-sectional view taken along line 11—11 in FIG. 9.

As best seen in FIGS. 1, 9, 10, and 11 the toothbrush 10 also provides a comfortable, easy to use handle 14. The handle 14 comprises a rounded portion 28 that fits comfortably in the hand. In the preferred embodiment the rounded portion 28 is cylindrical and has a hemispherical end portion 30. The rounded portion 28 may be other shapes as well, such as oval or oblate. Connected to the rounded portion 28 is a grip portion 32. During brushing, the user typically places a thumb on a first side 34 of the grip portion 32. This first side 34 is generally rounded and in relief with respect to cylindrical portion 28. The relief on the first side 34 provides a convenient resting place for a thumb. During brushing, the user also typically opposes the thumb with the forefinger, or another finger, by placing it against a second side 36 of the grip portion 32. In the preferred embodiment, the second side 36 has a beveled portion 38. As best seen in FIG. 11, on both sides of the bevel 38 are flattened portions 39, 41. The beveled portion 38 and flattened portions 39, 41 facilitate the rolling of the toothbrush 10 in the hands of the user. The beveled portion 38 allows the toothbrush 10 to easily and comfortably roll from one flattened portion 39 resting against the forefinger to the other flattened portion 41 resting against the forefinger as the user's thumb rolls the toothbrush 10 by pressing against the first side 34 of the grip portion 32. Thus, when the user switches from brushing from one side of the mouth to the other, the toothbrush 10 can be easily rolled from one side to the other, with less pronation or supination of the wrist and elbow. Further connected to the grip portion 32 is a neck 40 to which is connected the brush head 16.

To facilitate a greater understanding of the advantages of the illustrated preferred embodiment, operation of the toothbrush 10 is set forth as follows. To perform brushing, toothpaste or other tooth cleaning material is typically first placed so that it covers both the prophy bristles 18 and bristle tufts 12. The toothbrush 10 may also be used without toothpaste. Then, typically while holding the handle 14, the bristle tufts 12, are pressed against the teeth, and moved in a conventional tooth brushing manner. The bristle tufts 12 scrub the surface of the teeth and between teeth. As the toothbrush 10 is pressed harder against the teeth, the prophy bristles 18 press against the teeth, following the contour of the teeth, applying toothpaste to the teeth and thereby polishing the teeth. Thus, the combination of scrubbing and polishing the teeth provides a smoother, cleaner tooth surface than is provided by conventional toothbrushes.

Thus, an innovative prophy toothbrush, and a method for using the same have been disclosed. While variations of the illustrated preferred embodiment have been shown and described, it would be apparent to those skilled in the art that many more modifications are possible without departing from the inventive concepts herein. For example, instead of mounting the prophy bristles 18 and bristle tufts 12 on a brush head 16 connected to a handle 14, the prophy bristles 18 and bristle tufts 12 could be mounted to a platform without a handle. The invention, therefore, is not to be restricted except in the spirit of the appended claims.

I claim:

1. A toothbrush for cleaning teeth and cleaning under a plurality of gum lines, the toothbrush comprising:

(a) a brush head connected to a handle;

(b) the handle comprising:

(1) a hemispherical portion;

(2) a cylindrical portion connected to the hemispherical portion;

(3) a grip portion connected to the cylindrical portion, the grip portion comprising:

(A) a first side; and (B) a second side having a beveled portion; and (4) a neck portion connecting the grip portion to the brush head, wherein said neck portion is angled to said grip portion; and (c) a plurality of conical shaped, prophy bristles secured to the brush head, said prophy bristles mounted on a base; and (d) a plurality of bristle tufts secured to the platform, the bristle tufts comprising a plurality of individual bristles, wherein the bristle tufts taper at an angle between 5 to 8 degrees, from a portion most proximal to the handle to a portion most distal from the handle, with respect to the brush head.

2. A toothbrush for cleaning teeth and cleaning under a plurality of gum lines, the toothbrush comprising:

(a) a brush head connected to a handle;

(b) the handle comprising:

(1) a hemispherical portion;

(2) a cylindrical portion connected to the hemispherical portion;

(3) a grip portion connected to the cylindrical portion, the grip portion comprising:

(A) a first side; and (B) a second side having a beveled portion; and (4) a neck portion connecting the grip portion to the brush head, wherein said neck portion is angled to said grip portion; and (c) a plurality of prophy bristles secured to the brush head, said prophy bristles made of an elastomeric material;

(d) a plurality of bristle tufts secured to the brush head, the bristle tufts comprising a plurality of individual bristles, and being placed at least about a portion of the perimeter of the prophy bristles for closely following and cleaning the teeth surfaces and under the gum lines, wherein the bristle tufts taper at an angle between 5 to 8 degrees, from a portion most proximal to the handle to a portion most distal from the handle, with respect to the brush head, and wherein the prophy bristles taper at an angle between 5 to 8 degrees, from a portion most proximal to the handle to a portion most distal from the handle, with respect to the brush head.

3. A toothbrush as claimed in claim 2 wherein the prophy bristles are of a conical rounded shape.

4. A toothbrush as claimed in claim 2 wherein the bristle tufts extend above each prophy bristle.

* * * * *